US006745843B2

(12) United States Patent
Johnson et al.

(10) Patent No.: US 6,745,843 B2
(45) Date of Patent: Jun. 8, 2004

(54) BASE-PIPE FLOW CONTROL MECHANISM

(75) Inventors: Craig D. Johnson, Montgomery, TX (US); Matthew R. Hackworth, Pearland, TX (US); David W. Wang, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/054,337

(22) Filed: Jan. 22, 2002

(65) Prior Publication Data

US 2002/0096333 A1 Jul. 25, 2002

Related U.S. Application Data

(60) Provisional application No. 60/263,369, filed on Jan. 23, 2001.

(51) Int. Cl.[7] ..... E21B 43/12

(52) U.S. Cl. ..... 166/386; 166/205; 166/233; 166/234; 166/296

(58) Field of Search ..... 166/205, 227, 166/231, 233, 234, 296, 369, 373, 386

(56) References Cited

U.S. PATENT DOCUMENTS

| | | | | |
|---|---|---|---|---|
| 3,584,685 A | | 6/1971 | Boyd et al. | |
| 4,428,423 A | | 1/1984 | Koehler et al. | |
| 5,152,892 A | | 10/1992 | Chambers | |
| 5,355,948 A | | 10/1994 | Sparlin et al. | |
| 5,355,949 A | * | 10/1994 | Sparlin et al. | 166/236 |
| 5,394,938 A | * | 3/1995 | Cornette et al. | 166/51 |
| 5,476,143 A | * | 12/1995 | Sparlin et al. | 166/233 |
| 5,787,980 A | | 8/1998 | Sparlin et al. | |
| 5,829,522 A | | 11/1998 | Ross et al. | |
| 5,842,516 A | | 12/1998 | Jones | |
| 5,849,188 A | | 12/1998 | Voll et al. | |
| 5,881,809 A | | 3/1999 | Gillespie et al. | |
| 5,899,271 A | | 5/1999 | Simone et al. | |
| 5,909,773 A | | 6/1999 | Koehler et al. | |
| 5,938,925 A | | 8/1999 | Hamid et al. | |
| 5,980,745 A | | 11/1999 | Voll et al. | |
| 6,089,316 A | | 7/2000 | Spray | |
| 6,125,932 A | | 10/2000 | Hamid et al. | |
| 6,345,668 B1 | | 2/2002 | Reilly | |
| 6,457,518 B1 | * | 10/2002 | Castano-Mears et al. | 166/207 |
| 6,481,494 B1 | * | 11/2002 | Dusterhoft et al. | 166/51 |

FOREIGN PATENT DOCUMENTS

| | | |
|---|---|---|
| GB | 2 371 319 A | 7/2002 |

* cited by examiner

*Primary Examiner*—Zakiya Walker
(74) *Attorney, Agent, or Firm*—Williams, Morgan & Amerson P.C.; Jeffrey E. Griffin; Brigitte Jeffery Echols

(57) ABSTRACT

A completion assembly for use in a lateral well bore has a base pipe with a plurality of holes through the sidewall of the base pipe. Flow through the holes is regulated to produce an influx difference between the ends of the base pipe. Flow can be regulated by variably spacing or sizing the holes. Flow can also be regulated by selectively inserting a rod between adjacent splines located on the base pipe to cover and block the flow through certain holes in the base pipe. Flow can also be regulated using a rotatable sleeve adjacent to the base pipe such that rotation of the sleeve brings the holes and openings in the pipe and sleeve, respectively, into and out of alignment. A filter can be used to filter sand and other particulates. An erosion inhibitor can be used to extend the useful life of the assembly.

33 Claims, 9 Drawing Sheets

BASE-PIPE FLOW CONTROL MECHANISM

CROSS-REFERENCE TO RELATED APPLICATIONS

This application claims the benefit of U.S. Provisional Application 60/263,369, filed Jan. 23, 2001.

BACKGROUND OF THE INVENTION

1. Field of Invention

This invention relates generally to flow control in downhole completions. Specifically, this invention relates to the control of flow along the length of a horizontal downhole completion.

2. Related Art

Within the oil and gas industry, it is now fairly common to include lateral well bores that extend at an angle from a main vertical well bore. In some cases, the lateral well bores extend in a substantially horizontal direction from the main well bore.

A completion is typically deployed within such lateral well bores. The completion may include sliding sleeves, packers, and sand control equipment. Essentially, hydrocarbons flow from the formation intersected by the lateral well bore, into the lateral well bore, into the completion, and to the surface through the completion and associated tubing string.

However, in lateral well bores, specially those extending in a substantially horizontal direction, the flow rate into the completion is not equal along the length of the completion. Instead, due to the flow friction along the length of the completion, a higher flow rate tends to exist at the near end or "heel" of the lateral completion, and a lower flow rate tends to exist at the far end or "toe" of the lateral completion. The disparity in flow rate from the "toe" to the "heel" of the lateral completion, in turn, may lead to premature gas or water coning at the area of higher flow rate and/or may also decrease the total amount of hydrocarbons extracted from the relevant formation.

The prior art would therefore benefit from a system and method for equalizing the flow rate along a lateral completion.

SUMMARY OF THE INVENTION

The present invention uses an innovative design for a completion assembly for use in a lateral well bore having a base pipe with a plurality of holes through the sidewall of the base pipe. Flow through the holes is regulated to produce an influx difference between the ends of the base pipe. Flow can be regulated by variably spacing or sizing the holes. Flow can also be regulated by selectively inserting a rod between adjacent splines located on the base pipe to cover and block the flow through certain holes in the base pipe. Flow can also be regulated using a rotatable sleeve circumferentially adjacent to the base pipe such that rotation of the sleeve brings the holes and openings in the pipe and sleeve, respectively, into and out of alignment. A filter can be used to filter sand and other particulates. An erosion inhibitor can be used to extend the useful life of the assembly.

DETAILED DESCRIPTION

Figure 1:
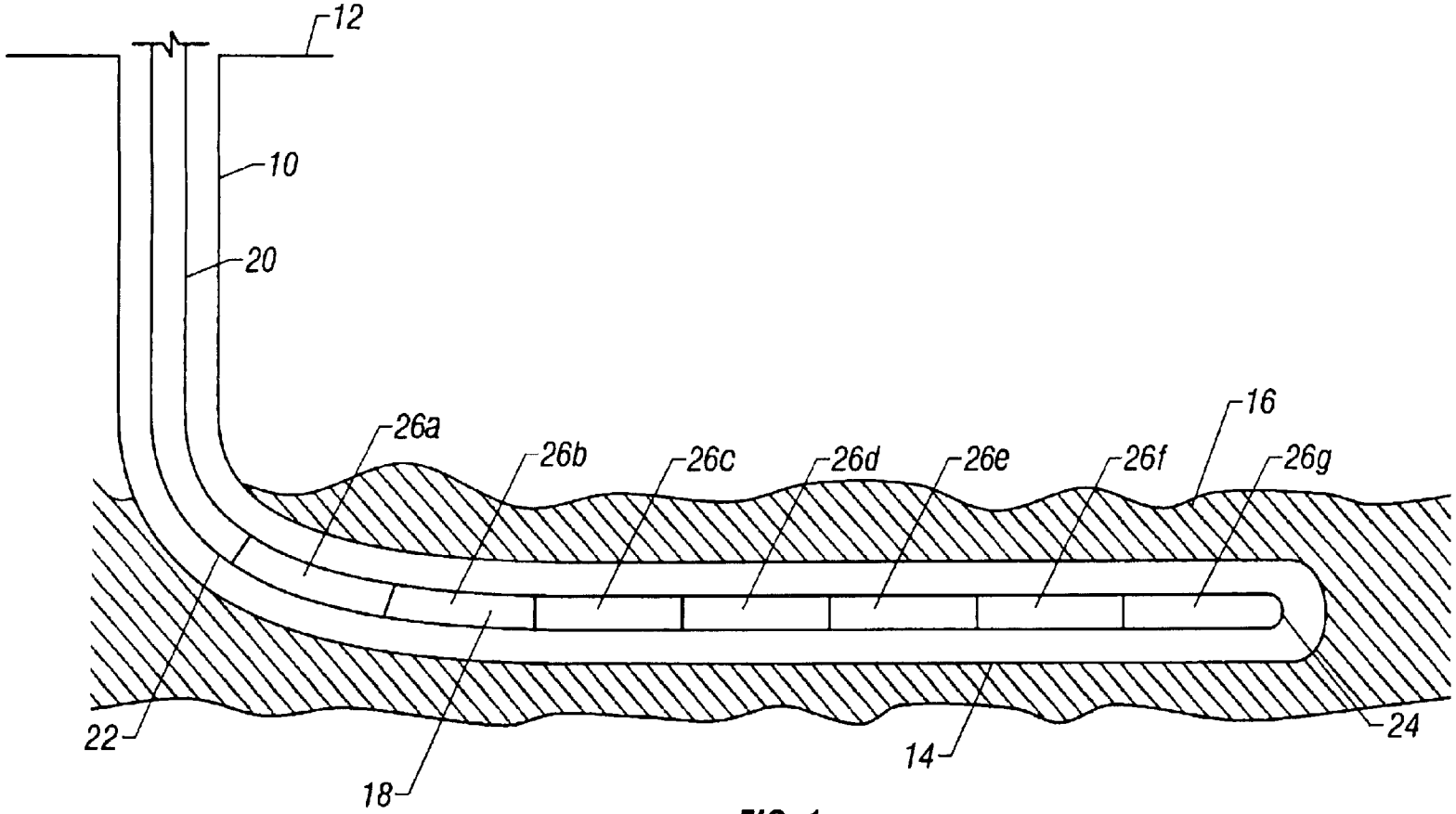
FIG. 1 is an elevation view of a lateral well bore extending from a main well bore, with a completion deployed therein, and generally utilizing the invention.

FIG. 1 generally illustrates a main well bore 10 extending from the surface 12 downwardly. A lateral well bore 14 extends from the main well bore 10 and intersects a hydrocarbon formation 16. A completion 18 extends within the lateral well bore 14 and includes a "toe" 24 at the far end of the completion 18 and a "heel" 22 at the near end of the completion 18. The completion 18 is connected to, for instance, tubing string 20 that extends within the main well bore 10 to the surface 12.

As previously discussed, without incorporating additional elements, due to the flow friction along the length of the completion 18, the flow rate into the lateral completion 18 at the heel 22 of the completion 18 is greater than the flow rate at the toe 24 of the completion 18. This invention evenly distributes the flow rate into the completion 18 by controlling the pressure drop into the completion 18 along the length of the lateral completion 18. This is achieved by varying the effective area of fluid communication between the completion 18 and the formation 16 (hereinafter referred to as the "Effective Area of Fluid Communication") along the length of the completion 18. In principle and all variables being equal, a completion section with a larger Effective Area of Fluid Communication will have a higher flow rate than a completion section with a smaller Effective Area of Fluid Communication. It is noted that a decrease in the Effective Area of Fluid Communication for a completion section results in an increase in pressure drop across such completion section, and vice-versa.

Essentially, the completion 18 is divided into sections 26(*a–g*) from the heel 22 to the toe 24, and the sections 26 are constructed so that the Effective Area of Fluid Communication for each section 26 increases from the section 26*a* closest to the heel 22 to the section 26*g* closest to the toe 24. Once calculated correctly, an increase of the Effective Area of Fluid Communication from the heel 22 to the toe 24 offsets (compensates for) the disparity in flow rate previously discussed, thereby evenly distributing the flow rate along the length of the completion 18. In one embodiment, such increase is a gradual increase. Three embodiments for the present invention are set forth herein.

First Embodiment

FIGS. 2–5 show the first embodiment of the invention. In this embodiment, each section 26 includes a base pipe 28 that has holes 30 extending therethrough. Each section 26 may also include a filter 32, such as a sand screen 34. Sections 26 may be coupled to each other by threaded couplings 36, for example. Hydrocarbon from the formation 16 typically flows from the formation 16, into the lateral well bore 14 (through perforations if included), through the filter 32 (if included), into the annular region 29 formed between the filter 32 and the base pipe 28, through the holes 30, into the central bore 31 of the lateral completion 18, and up to the surface 12 through the tubing string 20.

This embodiment comprises varying the number and/or size of the holes 30 for each section 26 so that an increase (a gradual increase in one embodiment) in the Effective Area of Fluid Communication (through the holes 30) can be achieved from the heel 22 to the toe 24 of the completion 18. Thus, the aggregate hole 30 area for each section 26 increases from the heel 22 to the toe 24 of the completion 18.

Figure 2:
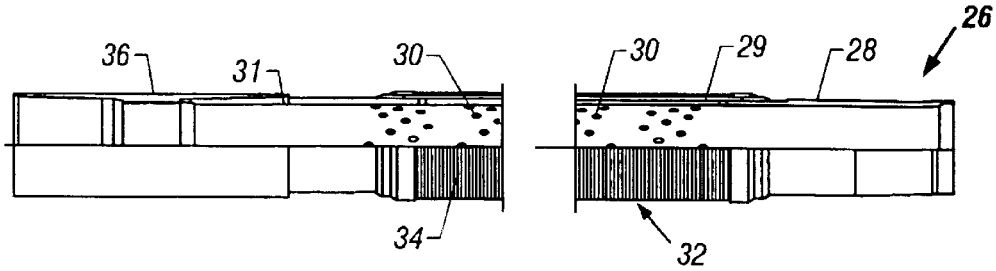
FIG. 2 is a partial cross-sectional view of a completion section that illustrates the first embodiment of this invention.
Figure 3:
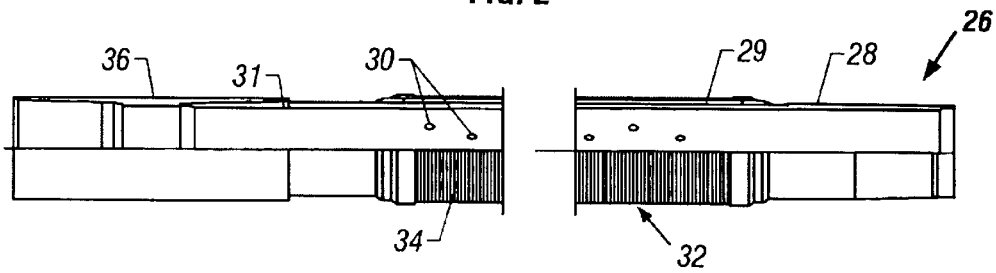
FIG. 3 is a partial cross-sectional view of another completion section that illustrates the first embodiment of this invention.
Figure 4:
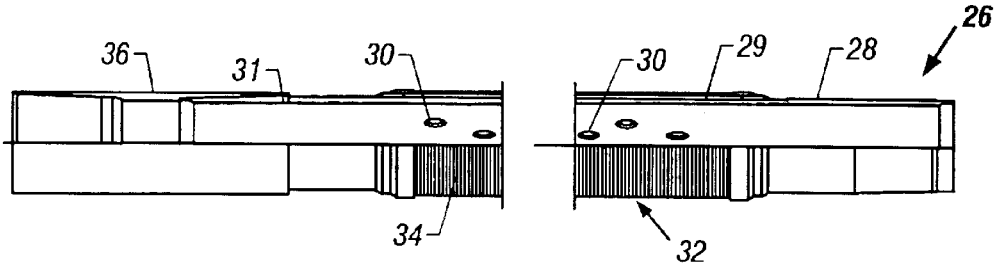
FIG. 4 is a partial cross-sectional view of another completion section that illustrates the first embodiment of this invention.
Figure 5:
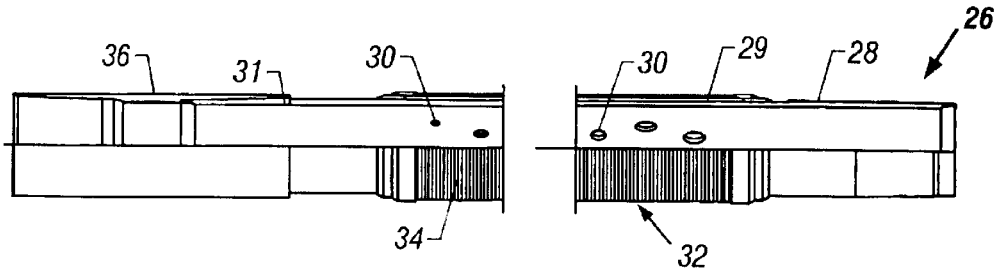
FIG. 5 is a partial cross-sectional view of another completion section that illustrates the first embodiment of this invention.

FIG. 2 shows a section 26 with a certain number of holes 30. FIGS. 3–5, comparatively, include sections 26 with a lesser number of holes 30 than shown in FIG. 2. Between FIGS. 3–5, it is noted that the size of the holes 30 of FIG. 3 are smaller than the size of the holes 30 of FIG. 4 and that the size of the holes of FIG. 5 increases from left to right.

The sections 26 shown in FIGS. 2–5 can be arranged in a variety of ways to achieve the objective of providing a gradual increase in the Effective Area of Fluid Communication from heel 22 to the toe 24 of completion 18. For instance, the sections 26 can be arranged so that section 26*a* has less holes 30 than section 26*g* and so that the number of holes 30 for each adjacent section 26(*a–g*) increases from section 26*a* to section 26*g*. Or, the sections 26 can be arranged so that the holes 30 of section 26*a* are smaller than the holes 30 of section 26*g* and so that the size of the holes 30 for each adjacent section 26(*a–g*) increases from section 26*a* to section 26*g*. Or, several sections 26 as shown in FIG. 5 may be used, wherein the sizes of the holes 30 not only increase from heel 22 to toe 24 from section 26 to section 26, but also increase within each section 26. The sections 26 can also be arranged so that the number as well as the size of the holes 30 increase from heel 22 to toe 24.

Second Embodiment

Figure 6:
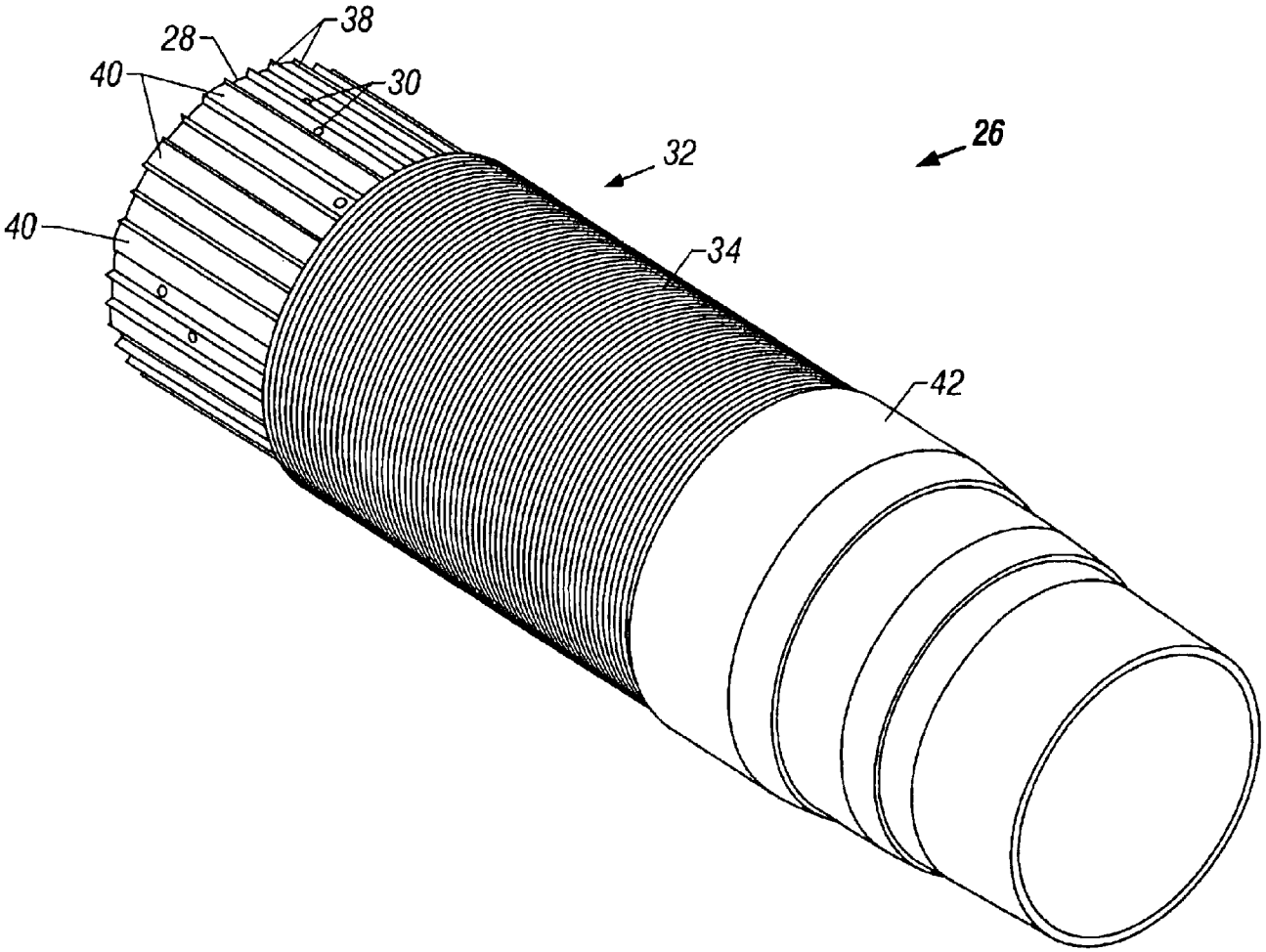
FIG. 6 is a partial cut-away view of a completion section that illustrates the second embodiment of this invention.
Figure 7:
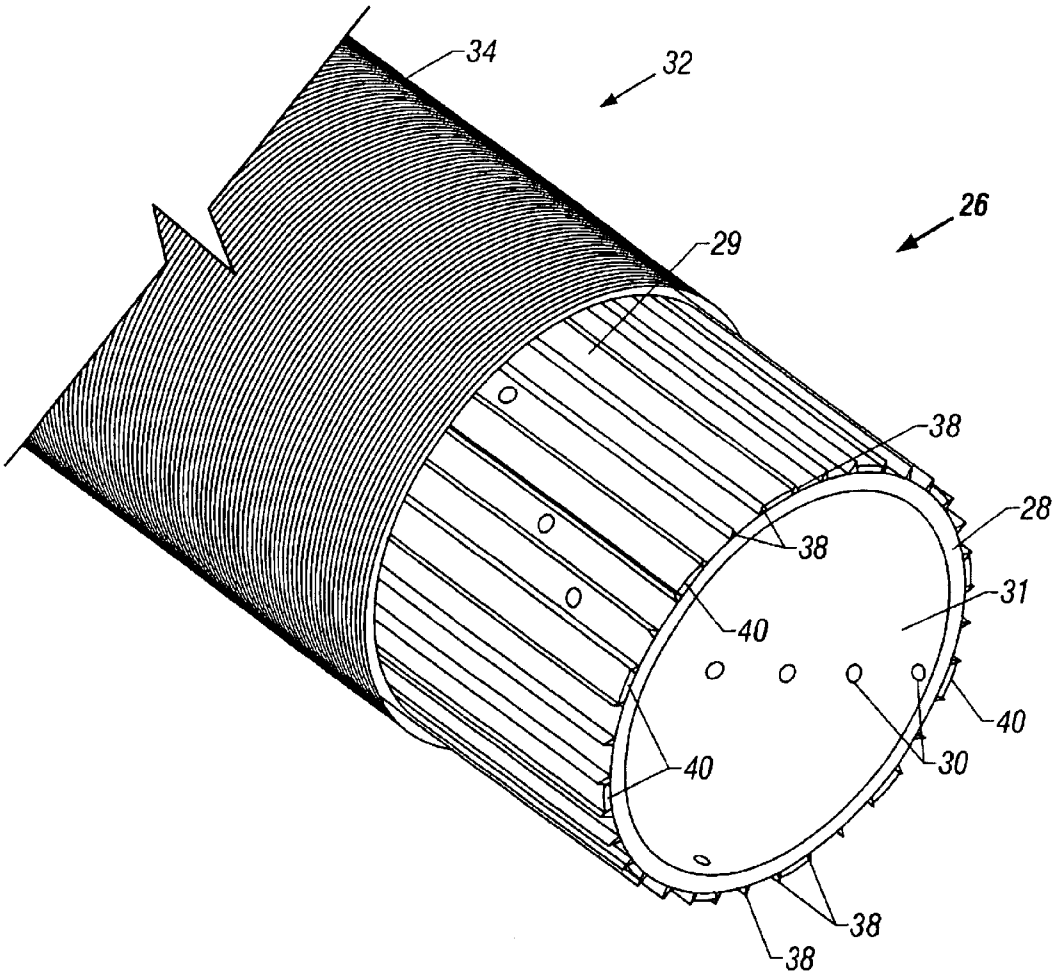
FIG. 7 is a more detailed partial cut-away view of a completion section that illustrates the second embodiment of this invention.

A second embodiment of the invention is shown in FIGS. 6 and 7, which for purposes of clarity are cut away views and do not show the entire section 26. In this embodiment, each section 26 also includes a base pipe 28 that has holes 30 extending therethrough. Each section 26 may also include a filter 32, such as a sand screen 34. Sections 26 may be coupled to each other by threaded couplings 36, for example. As is known in the art, a plurality of splines 38 typically provide support between the sand screen 34 and the base pipe 28. The splines 38 normally extend longitudinally along the length of the base pipe 28 and are spaced apart about the circumference of the base pipe 28. The holes 30 provide fluid communication from the area between the splines 38 to the central bore 31 of the base pipe 28. Thus, hydrocarbon from the formation 16 typically flows from the formation 16, into the lateral well bore 14 (through perforations if included), through the filter 32 (if included), into the annular region 29 formed between the filter 32 and the base pipe 28, through the holes 30, into the central bore 31 of the lateral completion 18, and up to the surface 12 through the tubing string 20.

In this embodiment, however, the number of holes 30 that provide such fluid communication can be modified by inserting a bar 40 between adjacent splines 38 so that such bar 40 covers the holes 30 located between such adjacent splines 38. Thus, the insertion of a bar 40 changes the number of holes 30 that provide fluid communication (thus changing the Effective Area of Fluid Communication through such section 26), thereby enabling an operator to change the pressure drop (and therefore flow rate) across each section 26. Of course, more than one bar 40 can be inserted in each section 26, each being inserted between different pairs of adjacent splines 38.

The bars 40 can be machined to a close tolerance to snugly fit between adjacent splines 38. Bars 40 can also be different lengths, thereby covering different numbers of holes 30. Bars 40 are constructed so that flow through a rod-covered hole 30 is severely restricted or altogether blocked.

The bars 40 can be inserted between the splines 38 either at the assembly facility or at the rig floor. To allow for simple insertion and removal at either site, each section 26 includes at least one end cap 42 that is easily selectively removed from the remainder of the section 26 thereby allowing access to the bars 40 and splines 38. Such end caps 42 may be attached to the base pipe 28 by mechanisms such as threading or clamping.

In use, bars 40 can be selectively inserted between adjacent splines 38 of the sections 26(*a–g*) so that the Effective Area of Fluid Communication (the aggregate hole 30 area) for each section 26 is controlled by the operator. In this manner, an operator can arrange the sections 26(*a–g*) to achieve the objective of providing an increase (a gradual increase in one embodiment) in the Effective Area of Fluid Communication from the heel 22 to the toe 24 of completion 18. For instance, given the same pattern, number, and size of holes 30 for each section 26, a decrease in the number of bars 40 used from section 26*a* to section 26*g* results in an increase in the Effective Area of Fluid Communication from the heel 22 to the toe 24 of completion 18.

It is noted that the bars 40 are not restricted to be used with only wire wrapped sand control screens. Their use can also be implemented with any screen that has an annular space between the base pipe and filter (screen).

Third Embodiment

Figure 8:
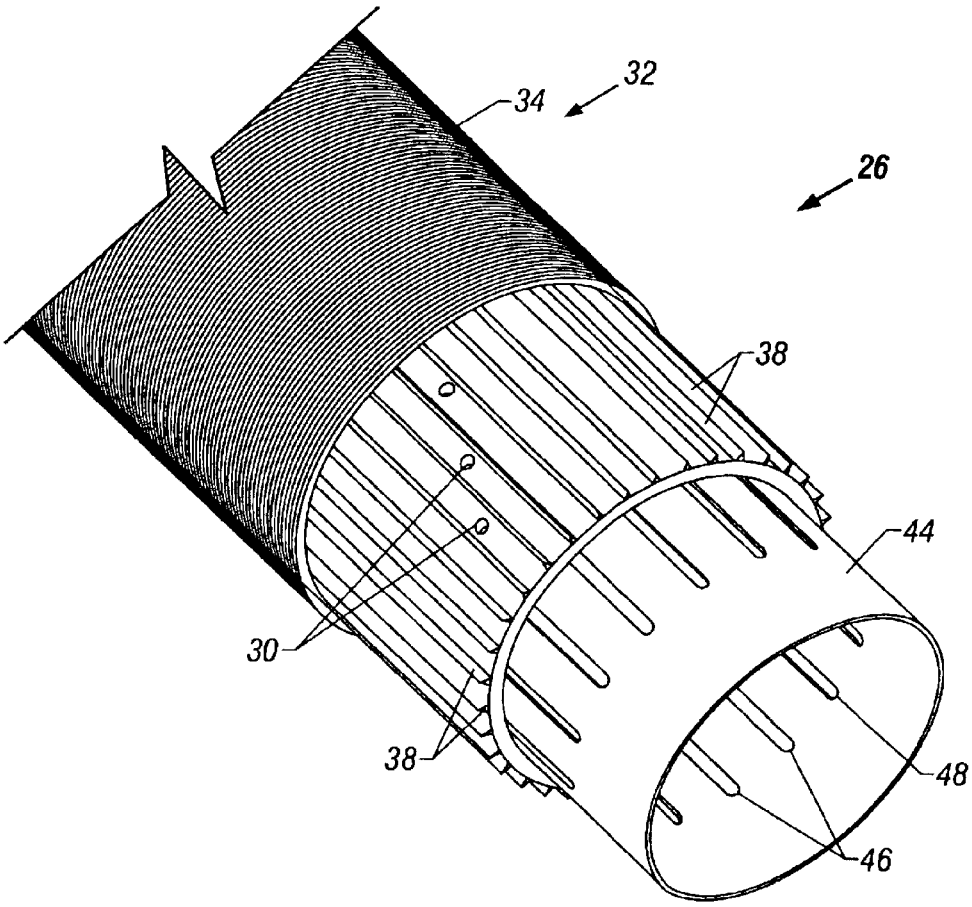
FIG. 8 is a partial cut-away view of a completion section that illustrates the third embodiment of this invention.
Figure 9:
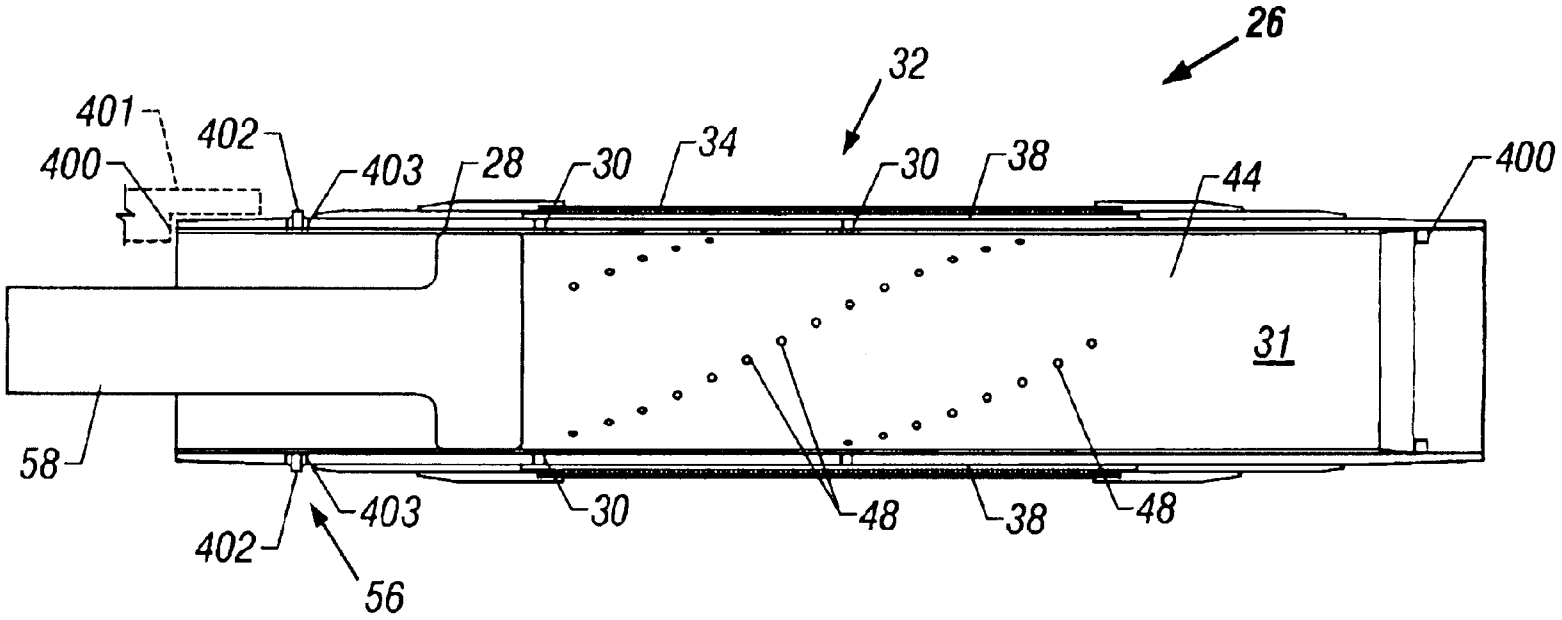
FIG. 9 is a cross-sectional view of a completion section that illustrates the third embodiment of this invention.
Figure 10:
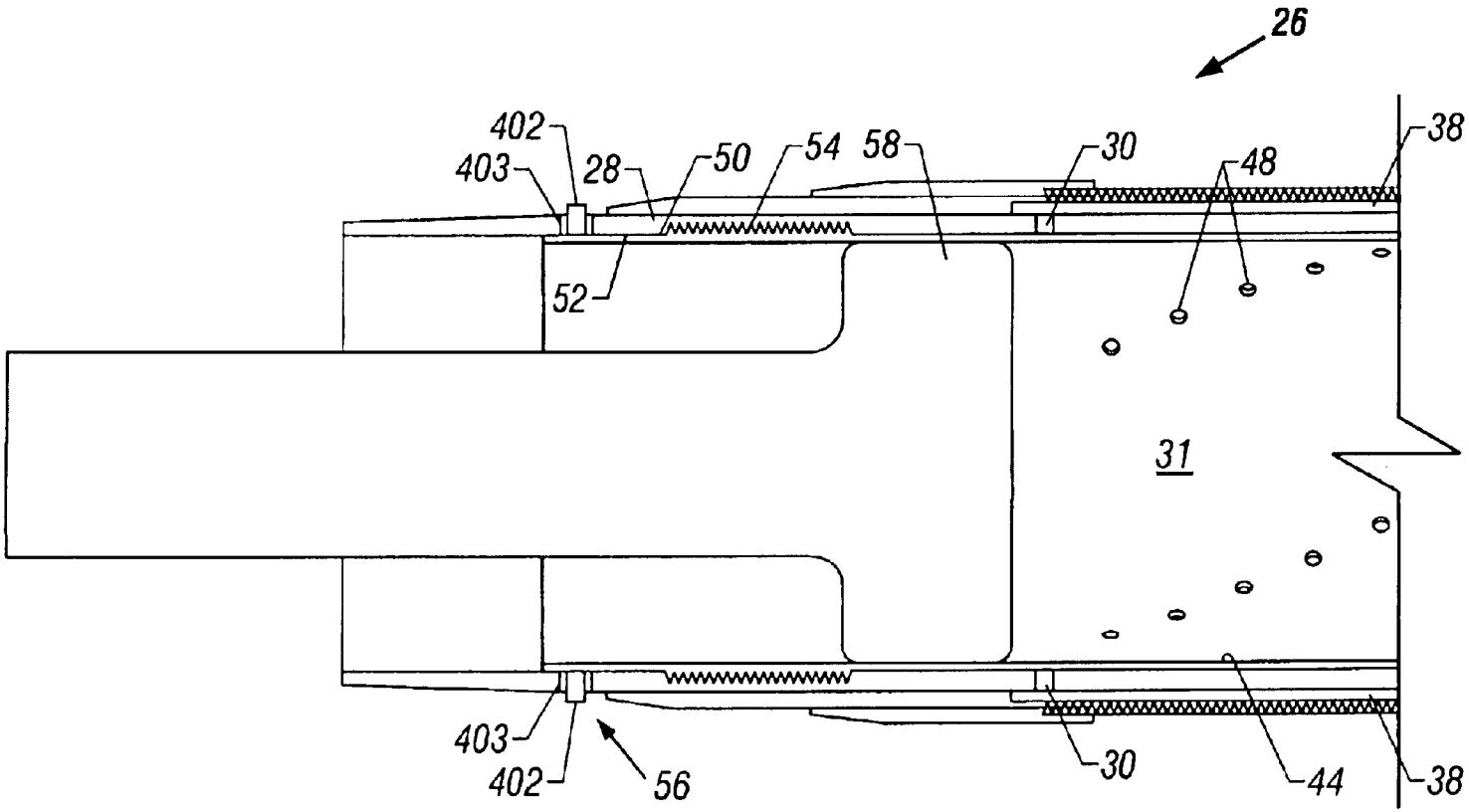
FIG. 10 is a more detailed cross-sectional view of one end of the completion section that illustrates the third embodiment of this invention.

A third embodiment of the invention is shown in FIGS. 8–10, which for purposes of clarity are cut-away and cross-sectional views and do not show the entire section 26. In this embodiment, each section 26 also includes a base pipe 28 that has holes 30 extending therethrough. Each section 26 may also include a filter 32, such as a sand screen 34. Sections 26 may be coupled to each other by threaded couplings 36, for example. As is known in the art, a plurality of splines 38 typically provide support between the sand screen 34 and the base pipe 28. The splines 38 normally extend longitudinally along the length of the base pipe 28 and are spaced apart about the circumference of the base pipe 28. The holes 30 provide fluid communication from the area between the splines 38 to the central bore 31 of the base pipe 28. Thus, hydrocarbon from the formation 16 typically flows from the formation 16, into the lateral well bore 14 (through perforations if included), through the filter 32 (if included), into the annular region 29 formed between the filter 32 and the base pipe 28, through the holes 30, into the central bore 31 of the lateral completion 18, and up to the surface 12 through the tubing string 20.

In this embodiment, however, the number and/or area of holes 30 that provide such fluid communication can be modified by rotation of a sleeve 44. The sleeve 44 can be located internally of the base pipe 28. The sleeve 44 includes openings 48 therethrough (which may be in the form of slots 46—see FIG. 8) that, depending on the position of the sleeve 44, line up with the holes 30 of the base pipe 28. The sleeve 44 can be rotated so that alignment of the openings 48 and the holes 30 can be varied, thereby modifying the Effective Area of Fluid Communication through each section 26.

To enable the rotational movement of the sleeve 44 within the base pipe 28, the outer surface 50 of the sleeve 44 is rotatably connected to the inner surface 52 of the base pipe 28. In one embodiment as shown in FIG. 10, the sleeve 44 is rotatably connected to the base pipe 28 by way of mating threads 54. Mating threads 54 can be included on one end of the sleeve 44 (as shown in FIG. 10), on both ends of sleeve 44, or along a large portion or the entirety of the outer surface 50 of sleeve 44. In another embodiment as shown in FIG. 9, the sleeve 44 may be slip-fitted within the base pipe 28 to allow their relative rotation. In this embodiment, axial movement of the sleeve 44 may be prevented by stops 400 protruding from the inner surface 52 of the base pipe 28. As shown in FIG. 9 on one of the ends of section 26, the stops 400 may comprise a threaded connector 401 used to connect two sections 26 together.

The sleeve 44 includes a selective locking mechanism 56 that enables the sleeve 44 to be locked (not rotatable) at different positions, each position allowing a different Effective Area of Fluid Communication through each section 26 (as previously discussed). The locking mechanism 56 can comprise, for example, set screws 402 threaded through set screw holes 403 of the base pipe 28 against the sleeve 44 to thereby prevent rotation of the sleeve 44. In another embodiment (not shown), the locking mechanism 56 can comprise an indexing ratchet mechanism.

The sleeve 44 can be rotated between positions at the assembly facility or at the rig floor. Once the section 26 is assembled, rotation of the sleeve 44 can be accomplished by the insertion of another tool 58 into the central bore 31. The tool 58 extends to the exterior of the section 26 so that the tool 58 can be easily manipulated by an operator. The tool 58 is selectively attached to the inner surface 60 of the sleeve 44, such as by mating threads or a mating profile (not shown). Once attached to the sleeve 44, the tool 58 is rotated by the operator to achieve the desired position between the openings 48 and the holes 30.

In use, the sleeves 44 can be rotated within the base pipes 28 of sections 26(*a–g*) so that the Effective Area of Fluid Communication (the aggregate hole 30 area) for each section 26 is controlled by the operator. In this manner, an operator can arrange the sections 26(*a–g*) to achieve the objective of providing an increase (a gradual increase in one embodiment) of the Effective Area of Fluid Communication from the heel 22 to the toe 24 of completion 18. For instance, the sleeve 44 of each section 26 can be positioned so that the Effective Area of Fluid Communication for the sections 26(*a–g*) increases from the heel 22 (section 26*a*) to the toe 24 (section 26*g*) of completion 18.

Combination of Embodiments

It is noted that the three embodiments previously described may be combined in the same completion 18. For instance, in the same section 26, the holes 30 can be varied in size and/or number (first embodiment) in combination with the use of the bars 40 (second embodiment) or the sleeve 44 (third embodiment). In addition, each section 26(*a–g*) may also comprise a different one of the of the three embodiments so that, for instance, the first embodiment is used in section 26*a*, the second embodiment is used in section 26*b*, and the third embodiment is used in section 26*c*.

Additional Optional Elements

Figure 11:
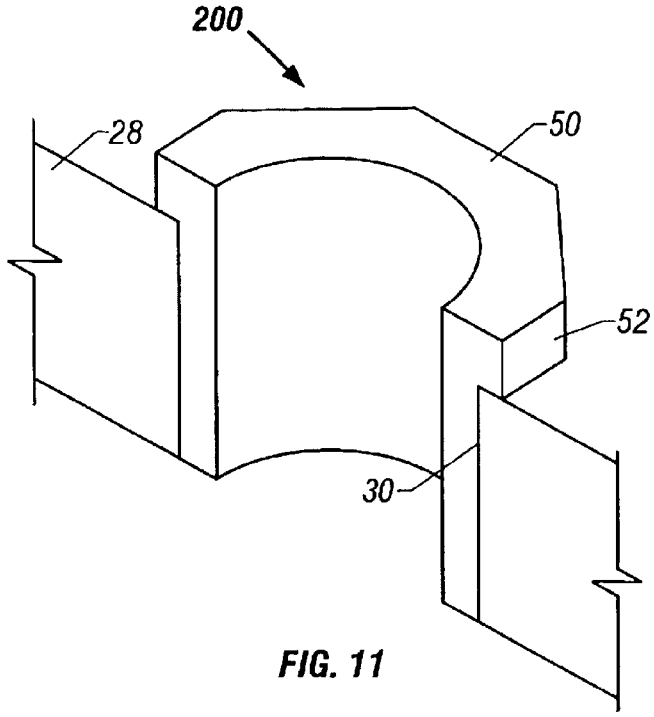
FIG. 11 is an isometric, cut-away view of an insert that can be included in the holes that extend through the completion sections of this invention.
Figure 12:
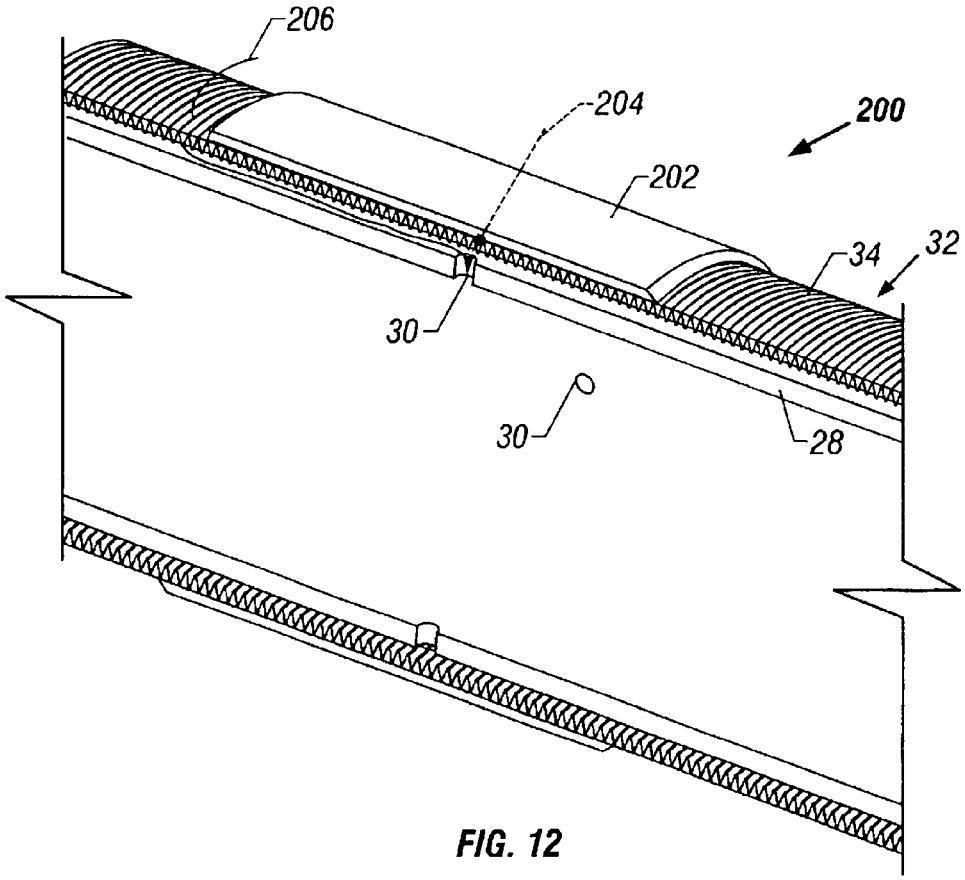
FIG. 12 is an isometric, cut-away view of a completion section including one embodiment of an erosion barrier.
Figure 13:
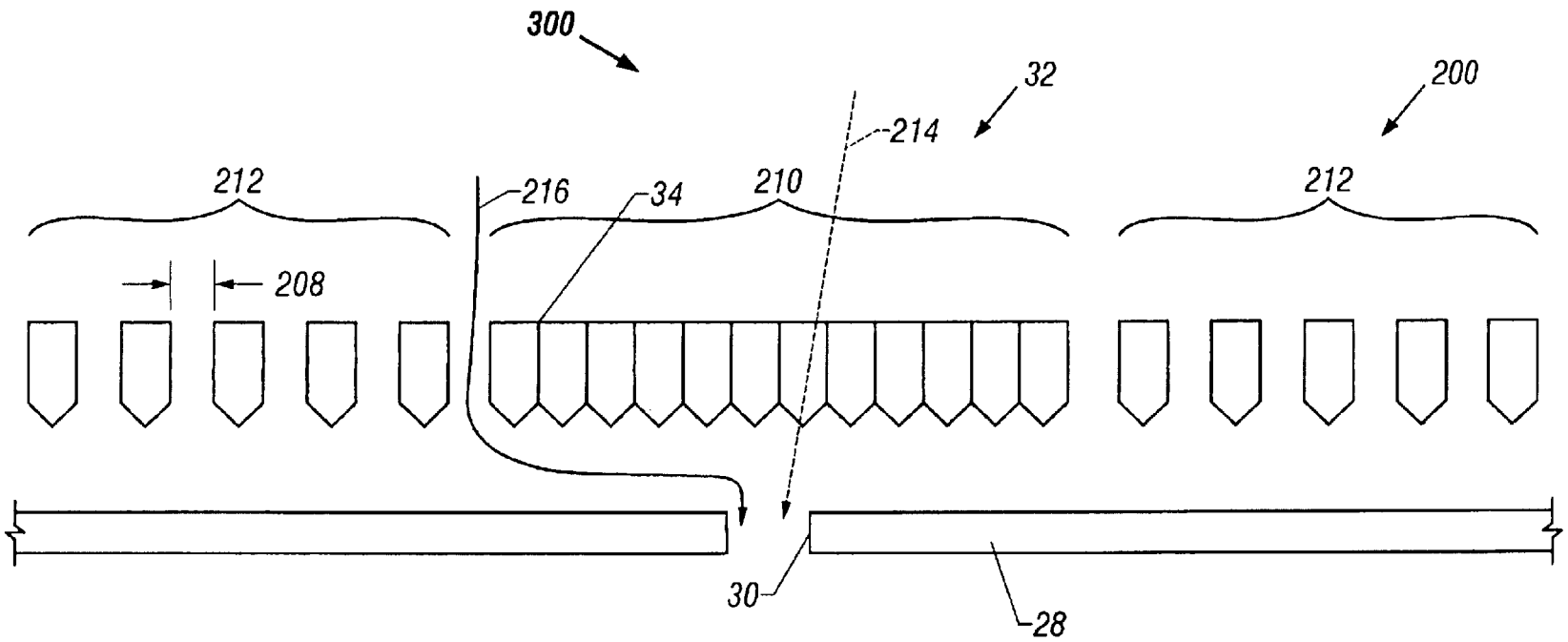
FIG. 13 is a cross-sectional view of a completion section including another embodiment of an erosion barrier.

FIGS. 11–13 show different embodiments of erosion inhibitors 200 that may be used with any of the embodiments previously described. It is noted that increasing the pressure differential across the base pipe holes 30 (by decreasing the Effective Area of Fluid Communication) leads to increased fluid velocity through the remaining holes 30. In turn, an increase in fluid velocity through base pipe holes 30 has been shown to erode the walls of the holes 30, which is of course undesirable. Moreover, an increase in fluid velocity may also erode the filter 32 or screen 34 through which such fluid is passing.

Turning to FIG. 11, to prevent such erosion on the walls of the holes 30, the erosion inhibitor 200 can comprise a hardened insert 50 that can be inserted in each hole 30. The insert 50 can be made of carbide, for example, or any other sufficiently hard and long-lived material. Each insert 50 is generally disc shaped to enable the fluid communication of hydrocarbons therethrough and is secured within its relevant hole 30 by means known in the art, such as welding, brazing, gluing, threading, or mechanical interference fit.

It is noted that the insert 50 shown in FIG. 11 includes a shoulder portion 52. Instead of shoulder portion 52, some inserts 50 may be flush with the base pipe 28 inner and outer surfaces.

FIG. 12 illustrates an erosion inhibitor 200 that helps to prevent erosion of the filter 32 (screen 34) and the walls of the holes 30. The erosion inhibitor 200 comprises a shield 202 attached to the exterior of the filter 32, such as by latching or welding. In one embodiment, the shield 202 surrounds the holes 30. The shield 202 prevents the fluid from flowing directly across the filter 32 and though the holes 30 (see dashed flow path 204), which can lead to erosion of either/both due to the high velocity of the fluid. Instead, the fluid must flow around the shield 202, through the filter 32, and through the holes 30 (see flow path 206). The path taken by the fluid around the shield 202 lowers the velocity of the fluid and thus aids in preventing erosion. Of course, more than one shield 202 can be included on each completion section 26.

FIG. 13 illustrates another embodiment of an erosion inhibitor 200 that helps to prevent erosion of the filter 32 (screen 34) and the walls of the holes 30. The erosion inhibitor 200 can comprise a specially designed screen 300 that includes a non-permeable screen section 210 and normal screen sections 212. In one embodiment, non-permeable screen section 210 surrounds the holes 30. Non-permeable section 210 does not include gaps and therefore prevents fluid from flowing therethrough. Normal sections 212 include the typical gaps 208 in such filters which allow fluid flow therethrough. The screen 300 (non-permeable section 210) prevents the fluid from flowing directly across the filter 32 and though the holes 30 (see dashed flow path 214), which can lead to erosion of either/both due to the high velocity of the fluid. Instead, the fluid must flow around the non-permeable section 210, through the gaps 208 of the normal sections 212, and through the holes 30 (see flow path 216). The path taken by the fluid around the non-permeable section 210 lowers the velocity of the fluid and thus aids in preventing erosion. Of course, more than one non-permeable section 210 can be included on each completion section 26

It is noted that the different embodiments of the erosion inhibitor 200 can be combined. Thus, inserts 50 can be used on the same section 26 (or completion 18) as the shield 202 or special screen 300. Moreover, the shield 202 and the special screen 300 can be used on the same section 26 (or completion 18).

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A completion assembly deployed within a well bore, comprising:

a base pipe having a sidewall with at least one hole through the sidewall;

a filter surrounding at least a portion of the base pipe;

a plurality of splines located between the base pipe and the filter; and a rod selectively insertable between adjacent splines, selectively covering the at least one hole.

2. The completion assembly of claim 1 in which the number of holes per unit area of the sidewall varies along the length of the base pipe.

3. The completion assembly of claim 2 wherein the number of holes per unit area of the sidewall, in conjunction with the placement of the rods, is chosen to produce a predetermined flow pattern for a predetermined well bore environment.

4. The completion assembly of claim 1 in which size of the holes varies along the length of the base pipe.

5. The completion assembly of claim 4 wherein the sizes of the holes, in conjunction with the placement of the rods, are chosen to produce a predetermined flow pattern for a predetermined well bore environment.

6. The completion assembly of claim 4 in which the number of holes per unit area of the sidewall varies along the length of the base pipe.

7. The completion assembly of claim 6 wherein the number of holes unit area of the sidewall and the sizes of the holes, in conjunction with the placement of the rods, are chosen to produce a predetermined flow pattern for a predetermined well bore environment.

8. The completion assembly of claim 1 wherein the rod is adjustably placed by an operator just prior to deployment of the completion assembly into the well bore.

9. The completion assembly of claim 1 further comprising an erosion inhibitor.

10. A completion assembly deployed within a well bore, comprising:

a base pipe having a central cavity enclosed by a sidewall the sidewall having a plurality of holes therethrough; and a sleeve circumferentially adjacent and rotatably attached to the base pipe, the sleeve having at least one opening therethrough, wherein rotation of the sleeve relative to the base pipe aligns or misaligns the holes and the at least one opening, such that the completion assembly is adapted to vary fluid communication between the well bore and the central cavity.

11. The completion assembly of claim 10 in which the number of holes per unit area of the sidewall varies along the length of the base pipe.

12. The completion assembly of claim 10 in which size of the holes varies along the length of the base pipe.

13. The completion assembly of claim 12 in which the number of holes per unit area of the sidewall varies along the length of the base pipe.

14. The completion assembly of claim 10 further comprising an erosion inhibitor.

15. The completion assembly of claim 10 wherein rotation of the sleeve relative to the base pipe aligns or misaligns the plurality of holes and the at least one opening to vary the point of entry into the base pipe.

16. The completion assembly of claim 10 further comprising a filter surrounding at least a portion of the base pipe.

17. The completion assembly of claim 10 wherein the at least one opening are longitudinal slots.

18. The completion assembly of claim 10 wherein the sleeve is adjustably placed by an operator just prior to deployment of the completion assembly into the well bore.

19. The completion assembly of claim 10 wherein the number of holes per unit area of the sidewall, in conjunction with the placement of the sleeve, is chosen to produce a predetermined flow pattern for a predetermined well bore environment.

20. A completion assembly deployed within a well bets, comprising:

a base pipe having a central cavity enclosed by a sidewall, the sidewall having a plurality of holes therethrough;

a sleeve circumferentially adjacent and rotatably attached to the base pipe, the sleeve having at least one opening therethrough, wherein rotation of the sleeve relative to the base pipe aligns or misaligns the holes and the at least one opening, such that the completion assembly is adapted to vary fluid communication between the well bore and the central cavity, wherein the number of holes per unit area of the sidewall and the sizes of the holes, in conjunction with the placement of the sleeve, are chosen to produce a predetermined flow pattern for a predetermined well bore environment.

21. A method of controlling a production flow from a well bore, comprising:

covering at least one of a plurality of holes defined by a base pipe;

disposing the base pipe in the well bore adjacent a formation; and flowing production fluid from the formation, through one or more uncovered boles, into the base pipe, wherein covering the at least one of the plurality of holes further comprises inserting a rod between adjacent splines of the base pipe to cover the at least one hole.

22. A method, according to claim 21, wherein flowing production fluid further comprises filtering the production fluids before it enters the base pipe.

23. A method, according to claim 22, further comprising inhibiting erosion of a filter for filtering the production fluid.

24. A method, according to claim 21, further comprising inhibiting erosion of the base pipe adjacent at least one of the plurality of holes.

25. A method, according to claim 21, further comprising varying a size of the plurality of holes along a length of the base pipe.

26. A method, according to claim 21, further comprising varying a number of the plurality of holes per unit area of the base pipe along the length of the base pipe.

27. A method of controlling a production flow from a well bore, comprising:

rotating a sleeve with respect to a base pipe such that an alignment of at least one opening defined by the sleeve and a plurality of holes defined by the base pipe is adjusted;

disposing the base pipe and the sleeve in the well bore adjacent a formation; and flowing production fluid from the formation, through the aligned at least one opening and plurality of holes, into the base pipe.

28. A method, according to claim 24, wherein flowing production fluid further comprises filtering the production fluid before it enters the base pipe.

29. A method, according to claim 28, further comprising inhibiting erosion of a filter for filtering the production fluid.

30. A method, according to claim 27, wherein rotating the sleeve with respect to the base pipe further comprises changing a point of entry of the production fluids into the base pipe.

31. A method, according to claim 27, further comprising inhibiting erosion of the base pipe adjacent at least one of the plurality of holes.

32. A method, according to claim 27, further comprising varying a size of the plurality of holes along a length of the base pipe.

33. A method, according to claim 27, further comprising varying a number of the plurality of holes per unit area of the base pipe along the length of the base pipe.

* * * * *